US006802732B1

(12) United States Patent
Bu et al.

(10) Patent No.: US 6,802,732 B1
(45) Date of Patent: Oct. 12, 2004

(54) CARD EDGE CONNECTOR

(75) Inventors: XueWu Bu, Künsan (CN); Dexi Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/659,609

(22) Filed: Sep. 9, 2003

(30) Foreign Application Priority Data

Jun. 6, 2003 (TW) ..... 92210430 U

(51) Int. Cl.[7] ..... H01R 13/62
(52) U.S. Cl. ..... 439/328; 439/157
(58) Field of Search ..... 439/327–329, 439/157, 155, 160

(56) References Cited

U.S. PATENT DOCUMENTS 4,898,540 A * 2/1990 Saito ..... 439/153
5,411,408 A * 5/1995 DiViesti et al. ..... 439/326
5,443,394 A * 8/1995 Billman et al. ..... 439/157
5,470,242 A * 11/1995 Cheng et al. ..... 439/157
5,676,561 A * 10/1997 Chiang ..... 439/328
5,820,396 A * 10/1998 Pan et al. ..... 439/328

* cited by examiner

*Primary Examiner*—Hien Vu
(74) *Attorney, Agent, or Firm*—Wei Te Chung

(57) ABSTRACT

A card edge connector (1) includes a dielectric housing (10) and a number of terminals (20). The dielectric housing includes an elongated base (12) and an arm (14) extending from one end of the base. The base includes an engaging face (121), an elongated slot (123) extending from the engaging face along a longitude axis thereof and a number of passageways (125) communicating with the slot (123). The arm includes a cavity (147) communicating with the slot adapted for receiving a side edge (21) of the electronic card (2) and a pair of resilient fingers (149) extending toward the engaging face adapted for resiliently sandwiching the electronic card. The terminals are received in the corresponding passageways and each has a contact portion exposed in the slot and a solder tail (22) extending beyond the base.

10 Claims, 3 Drawing Sheets

CARD EDGE CONNECTOR

BACKGROUND OF THE INVENTION

1. Field of the Invention

The present invention relates to a card edge connector, and particularly to a card edge connector with a pair of improved spring fingers molded integrally with a dielectric housing of the card edge connector.

2. Description of Related Art

A popular type of electrical connector which is used widely in the electronic industry is called a "card edge" connector. A card edge connector receives a printed circuit board (PCB) or card having a mating edge and a plurality of contact pads adjacent the edge. Such card edge connectors have an elongated base defining an elongate receptacle or slot for receiving the mating edge of the PCB and a pair of arms extending upwardly from opposite sides of the base. Each arm defines a cavity for receiving a side edge of the PCB. A plurality of terminals is spaced along one or both sides of the slot for engaging the contact pads adjacent the mating edge of the PCB. However, opposite inside walls of the cavity rigidly and mechanically sandwich the side edge of the PCB after the PCB is inserted into the edge cad connector, whereby the engagement between the PCB of the card edge connector may be affected adversely during the PCB being shocked or vibrated.

Referring to U.S. Pat. No. 5,411,408, one solution to the problem mentioned above is that the base is formed with two pairs of resilient fingers extending upwardly respectively from the opposite sides thereof adjacent to the arm. The fingers are able to resiliently sandwich the side edge of the PCB. However, the fingers extend beyond the base too long and structure of the finger is slim, such that the fingers are apt to be damaged during repeated insertion or misplug of the PCB. Additionally referring to U.S. Pat. No. 5,470,242, another solution to the problem mentioned above is that the card edge connector employs two pairs of spring tabs stamped and formed from metallic material assembled into opposite sides of the slot of the base respectively, the spring tabs are able to reliably and resiliently sandwich the PCB similarly. However, the card edge connector employs two pairs of additional spring tabs and adds a process of assembling the spring tabs into the slot, thereby increasing the cost of manufacture.

Hence, a card edge connector is desired to overcome the disadvantage of the prior art.

SUMMARY OF THE INVENTION

An object of the present invention is to provide a card edge connector having a pair of simple resilient fingers for ensuring a reliably engagement between the connector and an electronic card.

To achieve the above object, a card edge connector in accordance with the present invention comprises a dielectric housing and a plurality of terminals. The dielectric housing comprises an elongated base and an arm extending from one end of the base. The base comprises an upper engaging face, an elongated slot extending along a length of the base and a plurality of passageways communicating with the slot. The arm comprises a cavity communicating with the slot and a pair of resilient fingers extending downwardly in the cavity. The terminals are received in the corresponding passageways and each comprises a contact portion exposed in the slot and a solder tail extending beyond the base.

Other objects, advantages and novel features of the invention will become more apparent from the following detailed description when taken in conjunction with the accompanying drawings.

DETAILED DESCRIPTION OF THE PREFERRED EMBODIMENT

Figure 1:
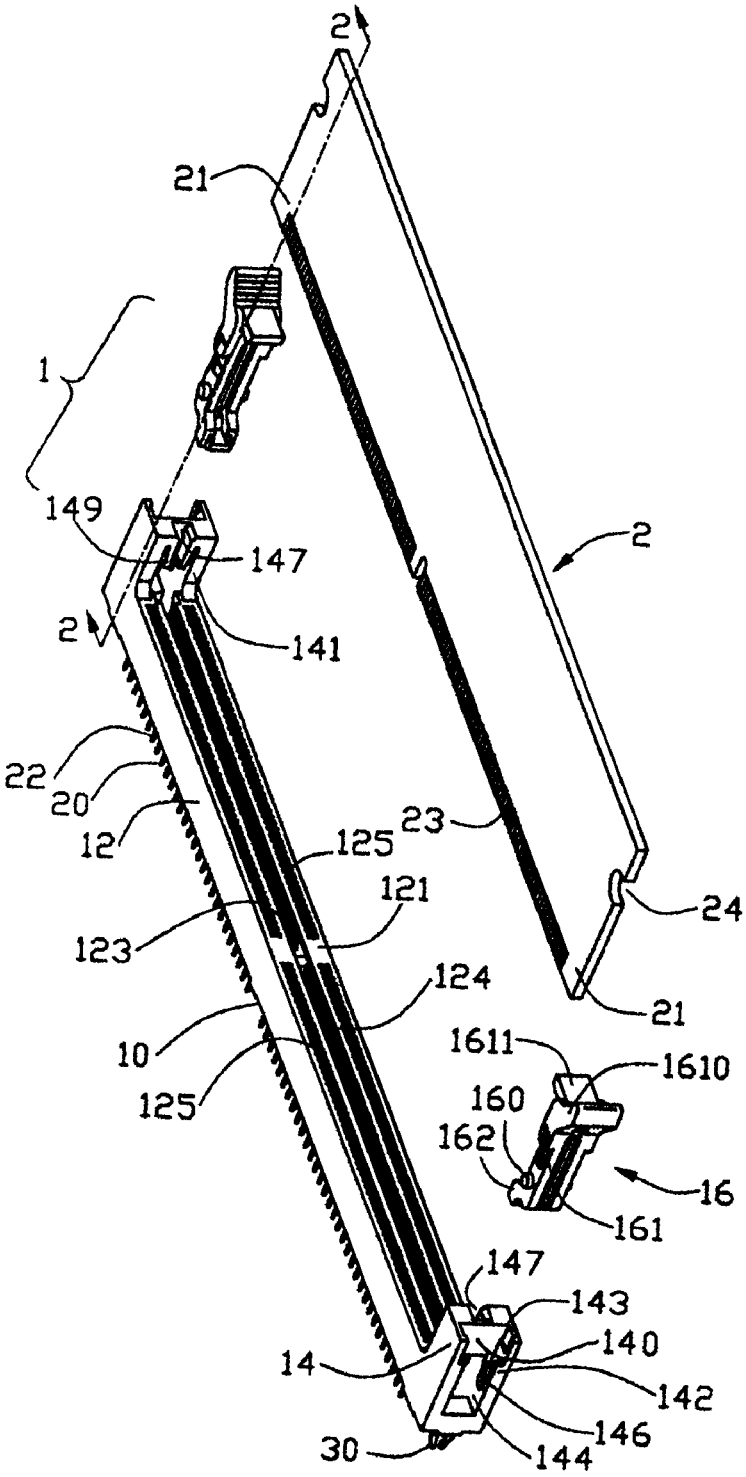
FIG. 1 is a perspective view of a card edge connector in accordance with the present invention and an electronic card, showing a pair of ejectors not assembled to the card edge connector.

Referring to FIG. 1, the invention is embodied in an elongated electrical connector 1 of the edge card type. The card edge connector 1 comprises an elongated dielectric housing 10, a plurality of terminals 20 received in the dielectric housing 10, a pair of ejectors 16 disposed in the dielectric housing 10 and a pair of board locks 30 retained to the dielectric housing 10 for locking the connector 1 onto a printed circuit board (not shown).

Figure 2:
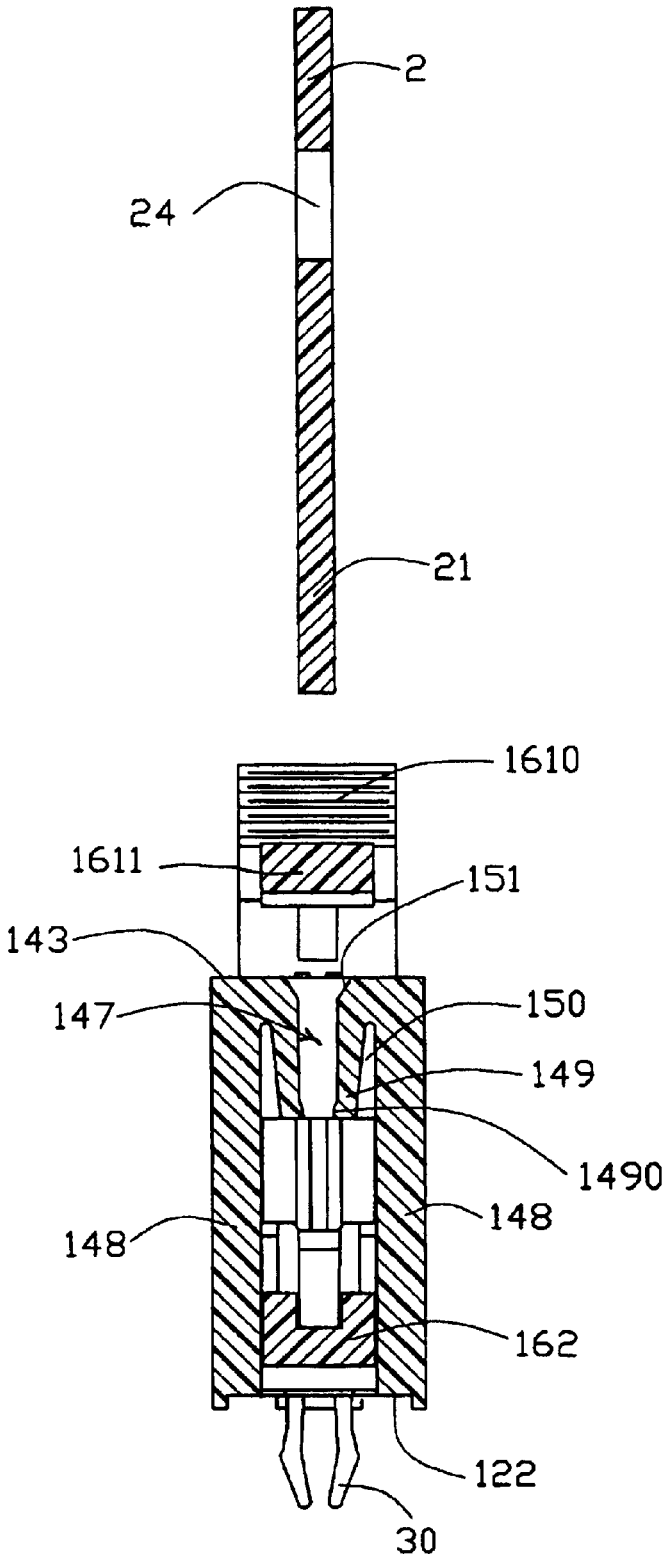
FIG. 2 is a cross-sectional view of the card edge connector and the electronic card taken along line 2—2 of FIG. 1, showing the ejectors are assembled to the card edge connector.

Referring to FIGS. 1 and 2, the dielectric housing 10 comprises an elongated base 12 and a pair of arms 14 extending upwardly from opposite sides of the base 12. The base 12 has an engaging face 121 and an opposite mounting face 122. The base 12 comprises a slot 123 extending from the engaging face 121 toward the mounting face 122 along a longitude axis thereof and a pair of side walls 124 respectively located at opposite sides of the slot 124. Each side wall 124 defines a plurality of passageways 125 communicating with the slot 123 and passing through the mounting face 122. The terminals 20 are received in the corresponding passageways 125, each comprises a contact portion (not shown) extending into the slot 123 for electrically contacting with a corresponding golden finger 23 of an electronic card 2 and a tail portion 22 extending beyond the mounting face 122 for electrically connecting with the printed circuit board.

Referring to FIGS. 1 and 2, each arm 14 has an inner side face 141 adjoining the engaging face 121 of the base 12, an outer side face 142 opposite to the inner side face 141 adjoining the mounting face 122 of the base 12 and a top face 143 interconnecting with the inner side face 141 and the outer side face 142. The arm 14 defines a chamber 144 extending from the outer side face 142 toward the inner side face 141 and passing through the top face 143. The lower portion of the chamber 144 communicates with the slot 123. A pair of holes 146 is defined respectively on opposite inside wall of the chamber 144. The ejectors 16 are received in the corresponding chambers 144, each comprises a pair of posts 160 protruding outwardly respectively from opposite side faces thereof and fitting in holes 146, an operator 161 located above the post 160 and partially received in the chamber 144 and an eject/kicker portion 162 located below the post 160 and extending through a lower portion of the corresponding neighboring cavity 147 (described in detail later) into the slot 123. The ejector 16 is able to rotate about the axis of post 160 within a certain range of angle. The operator 161 comprises an outer pressing portion 1610 and an inner projection/locker 1611 to engage with a cutout 24 of the electronic card 2 for securing the engagement between the connector 1 and the electronic card 2.

Figure 3:
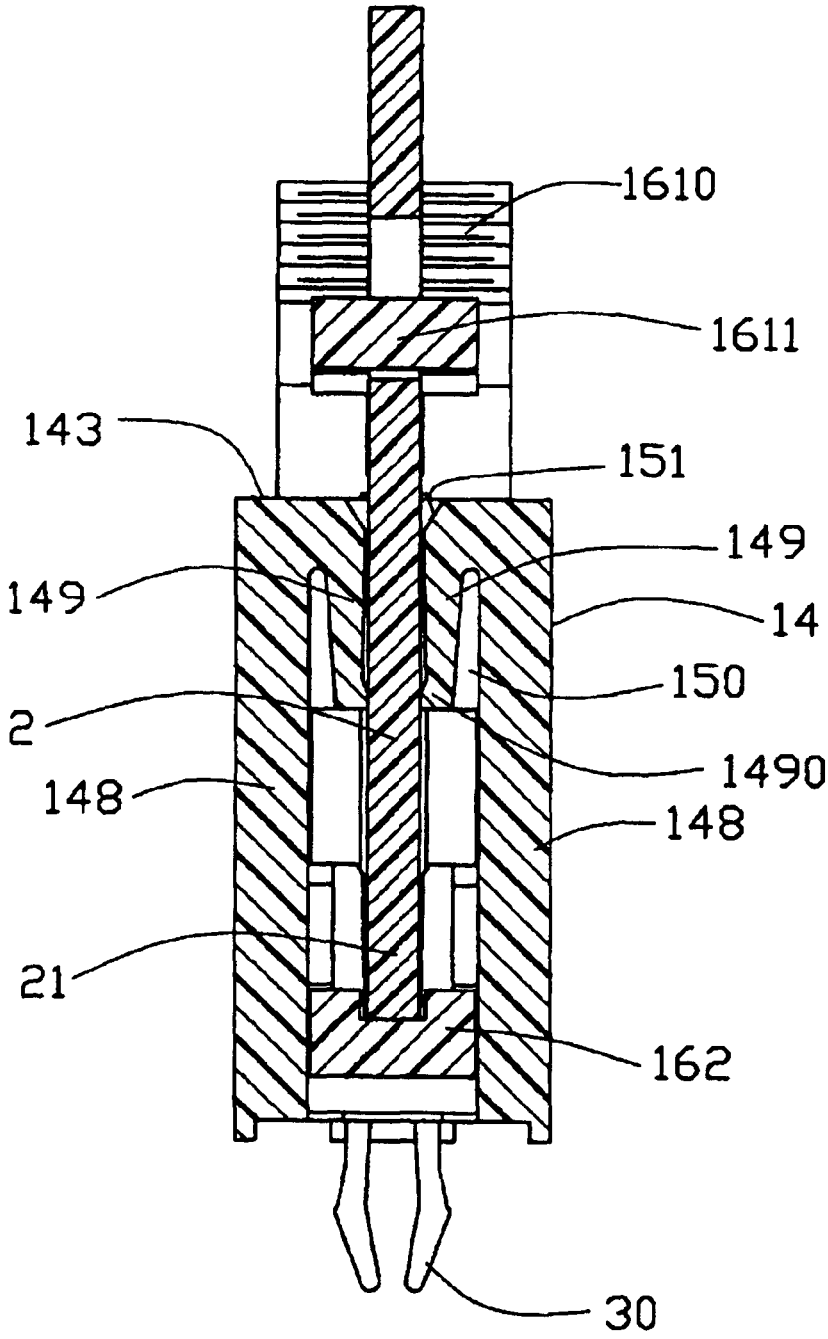
FIG. 3 is a view similar to FIG. 1, showing the electronic card is inserted into the card edge connector.

Referring to FIGS. 2 and 3, each arm 14 comprises a cavity 147 located beside the chamber 144 with a partition wall 140 therebetween, and extending from the inner side face 141 toward the outer side face 142 and through the top face 143, and a pair of inside walls 148 respectively located at opposite sides of the cavity 147. The cavity 147 communicates with the slot 123. The inside walls 148 is formed with a pair of resilient fingers 149 extending downwardly therefrom adjacent to the top face 143 into the cavity 147. A pair of slits 150 is defined between the resilient fingers 149 and the corresponding inside walls 148 for providing the resilient fingers 149 a space to flex. The resilient finger 149 defines a lead-in 151 adjacent to the top face 143 of the arm 14 for facilitate the electronic card 2 to insert. Each pair of resilient fingers 149 is formed with a pair of protrusion 1490 extending toward each other at a distal thereof. When the electronic card 2 is inserted into the connector 1, a side edge 21 of the electronic card 2 is received in the cavity 147 of the corresponding arm 14 and abuts against the eject portion 162 of the ejector 16, the protrusions 1490 of the corresponding resilient fingers 149 sandwich the side edge 21 of the electronic card 2 for providing the electronic card 2 a function of shock absorption to ensure the signal transmission between the electronic card 2 and the connector 1. It is noted that the resilient finger 149 is of a cantilever type not only for better resiliency thereof but also for not interfering with the eject portion 162 of the rotatable ejector 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

a dielectric housing comprising an elongated base and an arm extending from one end of the base, the base comprising an upper engaging face, an elongated slot extending along a length of the base and a plurality of passageways communicating with the slot, the arm comprising a cavity communicating with the slot and an insulative resilient finger formed from an inner wall of the arm and extending downwardly in the cavity; and a plurality of terminals received in corresponding passageways and each comprising a contact portion exposed in the slot and a solder tail extending beyond the base, wherein the insulative resilient finger and a proximal inside wall of the cavity define a slit therebetween, wherein the insulative resilient finger is formed with a protrusion at a lower end thereof, wherein the arm has an inner face adjoining the engaging face, an outer face opposite to the inner face and a top face interconnecting the inner face and the outer face, and wherein the cavity extends through the inner face and the top face, wherein the insulative resilient finger extends from adjacent the top face of the arm, wherein the card edge connector further comprising an ejector retained in the arm, and wherein the arm comprising a second insulative resilient finger opposing the insulative resilient finger.

2. The card edge connector as claimed in claim 1, wherein the resilient finger defines a lead-in adjacent to a top face of the arm.

3. The card edge connector as claimed in claim 1, wherein the base comprises a second arm extending from another end thereof.

4. The card edge connector as claimed in claim 1, wherein the arm defines a chamber communicating with the slot and receiving the ejector therein.

5. The card edge connector as claimed in claim 4, wherein the arm defines a pair of holes in opposite inside wall of the chamber, the ejector comprises a pair of posts engaging with the holes.

6. The card edge connector as claimed in claim 5, wherein the ejector comprises an operator located above the post and an eject portion located below the post and extending into the slot.

7. A card edge connector comprising:

a dielectric housing comprising an elongated base along a longitudinal direction thereof and an arm extending from one end of the base perpendicular to said longitudinal direction, the base comprising an outward engaging face, an elongated slot extending along a length of the base and a plurality of passageways communicating with the slot;

a plurality of terminals received in corresponding passageways and each comprising a contact portion exposed in the slot and a solder tail exposed outside the base;

a cavity defined in the arm and communicating with the slot, a cantilever type insulative resilient finger integrally formed from an inner wall of the arm and extending from a top face of the arm and downwardly in the cavity;

a chamber defined in the arm and located beside said cavity; and a rotatable ejector disposed in the chamber with an eject portion extending through a lower portion of the cavity under the finger, and into the slot, wherein the resilient finger is formed with a protrusion at a lower end thereof, wherein the arm comprised a second cantilever resilient finger opposing the insulative resilient finger; and wherein the finger terminates at a middle portion of said arm.

8. The connector as claimed in claim 7, wherein said finger is deflectable in a transverse direction perpendicular to said longitudinal direction.

9. The connector as claimed in claim 7, wherein a partition wall is located between said cavity and said chamber.

10. An electrical connector assembly comprising:

a dielectric housing comprising an elongated base along a longitudinal direction thereof and an arm extending from one end of the base perpendicular to said longitudinal direction, the base comprising an outward engaging face, an elongated slot extending along a length of the base and a plurality of passageways communicating with the slot;

a plurality of terminals received in corresponding passageways and each comprising a contact portion exposed in the slot and a solder tail exposed outside the base;

a cavity defined in the arm and communicating with the slot, a cantilever type insulative resilient finger integrally formed from an inner wall of the arm and extending from a top face of the arm into the cavity;

a chamber defined in the arm and located beside said cavity;

a rotatable ejector disposed in the chamber with a kicker portion extending through a lower portion of the cavity under the finger, and into the slot; and a printed circuit board inserted into the housing with a bottom edge section received in the slot and with a side notch latched by a locker of said ejector, wherein the resilient finger is formed with a protrusion at a lower end thereof, wherein the arm comprised a second cantilever resilient finger opposing the cantilever resilient finger.

* * * * *